US005112055A

United States Patent [19]

Barnhill

[11] Patent Number: 5,112,055

[45] Date of Patent: May 12, 1992

[54] GOLF BALL INCLUDING SOUND EMITTING MEANS

[76] Inventor: William R. Barnhill, P.O. Box 34213, Clermont, Ind. 46234

[21] Appl. No.: 714,633

[22] Filed: Jun. 13, 1991

[51] Int. Cl.[5] ..... A63B 43/00

[52] U.S. Cl. ..... 273/213; 273/58 E; 273/DIG. 20; 273/58 G; 446/270; 446/409; 29/899

[58] Field of Search ..... 273/213, 58 G, 183 C, 273/DIG. 24, 58 E; 446/270, 409; 29/899

[56] References Cited

U.S. PATENT DOCUMENTS

| | | | |
|---|---|---|---|
| 1,620,290 | 3/1927 | Rubin | 273/213 |
| 3,804,411 | 4/1974 | Hendry | 273/58 G |
| 3,935,669 | 2/1976 | Potrzuski | 273/213 X |
| 4,002,893 | 1/1977 | Newcomb et al. | 273/58 G X |
| 4,421,319 | 12/1983 | Murphy | 273/213 X |

*Primary Examiner*—George J. Marlo
*Attorney, Agent, or Firm*—Robert A. Spray

[57] ABSTRACT

A signal-emitting golf ball, having a chamber formed into its outer surface as a manufacturing step after the ball has been formed into its generally spherical shape.

The chamber is of a form providing a reception chamber for the signal-emitting means being placed inwardly of the ball's outer surface at a manufacturing stage in which the signal-emitting means are not subject to ball-shaping or prior manufacturing steps.

A novel signal-emitting device, shock-activated in nature, is provided to be silent through the practice swinging, but automatically emits a sound upon the ball being struck, and it keeps sounding until the player finds it and wishes it silent for the next shot, although preferably the sound is dim enough and steady enough so as to not be a bother.

15 Claims, 4 Drawing Sheets

GOLF BALL INCLUDING SOUND EMITTING MEANS

I. FIELD OF THE INVENTION

The present invention relates to golf balls, and more particularly to golf balls having signal-emitting means carried by the golf ball for providing help in finding a ball which has been lost.

As cited below, the problem of lost golf balls, as due to a misdirected hit of the ball into an area of trees, bushes, leaves, etc., has been a problem of golfers for many years.

The loss of a ball is not only a loss of value of the ball, but also causes a waste of time searching for the ball, all as is well known.

II. SUMMARY OF THE PRESENT INVENTION

The invention, in basic summary, includes the provision of a cavity in the ball as a manufacturing step after the ball has been formed into its spherical shape, the signal-emitting means then being placed into the cavity at a manufacturing stage after ball-forming steps which would have any adverse effects on the signal emitting means.

A novel signal-emitting device, shock-activated in nature, is provided to be silent through the practice swing procedure; but automatically emits a sound upon the ball being struck, and it keeps sounding until the player finds is and wishes it silent for the next shot, although preferably the sound is dim enough and steady enough so as to not be a bother.

A plurality of embodiments are shown.

III. PRIOR ART HELPS TO SHOW INVENTIVENESS HERE

Prior art, which has been found by the present inventor in searches made in his considering the likelihood and showing the justification of pursuing a patent for the present invention, shows in a plurality of ways the non-obviousness of the present invention; and thus the prior art is more an indication of non-obviousness and thus inventiveness of concept than even hindsight indication of either showing or suggesting the present invention or its basic concepts.

More particularly as to the prior art, in a hindsight consideration of the present invention to determine its inventive and novel nature, it is not only conceded but emphasized that the prior art had details usable in this invention but only if the prior art had had the guidance of the present concepts of the present invention.

That is, it is emphasized that the prior art had/or knew several particulars which individually and accumulatively show the non-obviousness of this combination invention:

a. The prior art has long had mechanisms of various types which could produce all the particulars of the present invention.

b. The prior art knows the advantages of lower manufacturing costs in combination with a workable product and process.

c. The prior art has long had the problem of lost golf balls, even if only partly obscured by terrain features.

d. The prior art has long known of the disadvantages of "slow play" by golfers on a busy golf course, with increasing instances of golf course administrators imposing penalties against slow players.

e. The prior art has even had all of the sound emitting apparatus details and component-forming machinery and procedures and ability which could have been used to provide the advantageous sound-emitting device of the present invention, but only if the prior art had had the concepts.

In spite of all such factors of the prior art, the problem here solved awaited this inventor's creativity. More particularly, as to the novelty here of the invention as considered as a whole, a contrast to the prior art helps show its contrast to the present concepts, and emphasizes the advantages and the inventive significance of the present concepts as are here shown, and the nature of the concepts and their results can perhaps be easier understood.

Even further as indicating the inventive nature of the present concepts is the result of search efforts made after this invention was made, and during the course of considering the desire and likelihood of patent protection.

The Search efforts produced the following, as cited below, as mentioned below as to what seem to the present inventor to be the least remote ones. Indeed, these references fail to show or suggest the details of the present concepts; and a realistic consideration of the prior art's several differences from the present concepts may more aptly be described as teaching away from the present invention's concepts, in contrast to suggesting them, even as to a hindsight attempt to perceive suggestions from a backward look into the prior art. Those prior art examples are:

P. S. Kane, U.S. Pat. No. 1,583,721, May 4, 1926: A golf ball comprising a visible smoke signaling device, but no indication of sequence of forming steps is indicated, and it has no sound means; but it is an illustration of the prior art of at least 65 years recognizing the golf ball locator problem, and attempting to solve the problem by a variety of quite diverse manners, constructions, and methods. Yet none of the years of prior art attempts seems to have been successful, even though golf as a sport has grown immensely throughout those many years, and even though all golfers including surely many of "mechanical know how" and even of inventive ability surely have been irked and frustrated by the lost ball problem not merely by it being an item of expense but by game penalties, frustration, time wasting, etc.

A. J. Rubin, U.S. Pat. No. 1,620,290, Mar. 8, 1927: A golf ball containing a spring wound sounding device, but no indication of sequence of forming steps is indicated; moreover, the small outlet passage, and the cavity's size and shape, indicate that it would have to be made prior to the step of forming the spherical shape of the ball.

S. J. Bens, U.S. Pat. No. 1,664,397, Apr. 3, 1928: A golf ball detected by sight, sound or smell; and it has no internal cavity. Sound is produced by a "crackling series of miniature explosions" of chemicals on the ball's surface.

F. Veatch, U.S. Pat. No. 2,861,810, Nov. 25, 1958: A highly light-reflective golf ball, and no cavity.

C. J. Smith et al., U.S. Pat. No. 3,351,347, Nov. 7, 1967: A ball which radiates light energy, and although an electric circuit is used, it is used to produce light through layers; and the internal components would have to be interiorly of the ball prior to shaping the ball.

A. P. Pedrick, 1,121,630, Jul. 31, 1968 (British): A golf ball containing metal or radio-active material. The golfer would wear a Geiger counter.

A. C. Wickman, 1,172,449, Nov. 26, 1969 (British): A golf ball containing radio-active material; and again, the golfer senses radiation by a Geiger counter.

Horchler, U.S. Pat. No. 3,782,730, Jan. 1, 1974: A golf ball containing RF transmitter, allowing it to be located with a receiver; and its transmitter device cannot be inserted after shape-forming of the ball.

Ratkovich, U.S. Pat. No. 3,790,948, Feb. 5, 1974: A radio transmitting arrow with finding means; but it is not only from a different field of art than a golf ball, its electric energy-actuator is different from that of the present invention.

Miller et al., U.S. Pat. No. 4,065,537, Dec. 27, 1977: Process for producing molded golf-balls exhibiting isometric compression; and its nature is of a solid ball, it has no cavity, and no transmitter. A. W. Ready, 1,530,266 Oct. 25, 1978 (British): A golf ball including metallic material enabling it to be detected; no cavity, and no insertion of a sound emitter.

Yamada, U.S. Pat. No. 4,625,964, Dec. 2, 1986: Shows the construction of a solid golf ball; but it has no cavity, and no electrical sound effect.

Barricks et al., U.S. Pat. No. 4,660,039, Apr. 21, 1987: Sport object has conductive stripe which increases load on transmitter; quite different from the present invention.

Newcomb et al., U.S. Pat. No. 4,695,055, Sep. 22, 1987: Illuminated translucent golf ball; and, although it has a diametrically-extending hole, which may be drilled after the ball is shaped, the hole is only to receive a luminescent plug.

Sahr, Ingrid, 3,609,016, Sep. 24, 1987 (German): A golf ball with a built in resonance-chip for a microwave sending unit built into a golf club.

Schooler et al., 2,188,415, Sep. 30, 1987 (British): A golf ball location device comprising a infrared or visible light source; which detects light reflected off a golf ball. Schooler et al., 2,188,554, Oct. 7, 1987 (British): A golf ball containing metal which allows it to be detected.

L. D. Brailean, U.S. Pat. No. 4,749,198, Jan. 7, 1988: A hunting arrow comprising a radio transmitter that is receivable; but as an arrow-finder, seems to be not readily adaptable to a golf ball locator device.

M. Weber, 3,732,762, Apr. 6, 1989 (German): A golf ball comprising a sending unit and a receiver capable of receiving signal; quite complex device with a direction finder, compasses, distance measurer, for providing not only audible but a visual locator-signal.

"Beacon" advertisement cites the Brailean U.S. Pat. No. 4,749,198 in September 1990 issue of Deer & Deer Hunting, p. 81 and other non-numbered pages; "Sound Tracker" advertisement by Sporting Technologies, Inc., in Bowhunting World, p. 143, Fall 1990, an arrow locator. The device shown seems to be similar to the Brailean Pat. No. 4,749,198 and the Beacon arrow locator cited above, although the arrow's interior is not fully shown.

Accordingly, although various concepts are conceded and emphasized to have been known and used in the prior art, nevertheless, the prior art not having had the particular combination of concepts and details as here presented, and shown as a novel combination or combinations, significantly different from the prior art and its suggestions, even only a fair amount of realistic humility, to avoid consideration of this invention improperly by hindsight, requires the concepts and achievement here to be realistically viewed as a novel combination, inventive in nature. And especially is this a realistic consideration when viewed from the position of a person of ordinary skill in this art at the time of this invention, and without trying to reconstruct this invention from the prior art without use of hindsight toward particulars not suggested by the prior art of all relevant fields.

IV. BRIEF DESCRIPTION OF THE DRAWINGS

The above description of the novel and advantageous invention is of somewhat introductory and generalized form. More particular details, concepts, and features are set forth in the following and more detailed description of illustrative embodiments, taken in conjuction with the accompanying drawings which are of somewhat schematic and diagrammatic nature, for showing the inventive concepts:

FIG. 2 shows a golf ball in its spherical form;

FIG. 3 is a view like FIG. 2 but now showing a cavity or recess extending diametrically through the ball, and showing threads in the recess, for accommodation of a sound/emitting device;

FIG. 4 is a view similar to FIG. 3 except that the cavity does not extend fully to one side of the ball; and FIG. 5 is a view of the ball shown in FIG. 4, with the exception that FIG. 5 shows the cavity having now received a sound-emitter device, and the ball is provided with an outlet opening for ease of sound-emission through the inner wall of the recess;

FIG. 6 shows the parts in a cocked but non-sounding position, as if the ball is waiting to be struck;

FIG. 7 shows the parts in a sound-emitting condition, after the ball has been struck, releasing the latch by movement (here leftwardly) of the outer shell by the ball being struck (here from the right), and the release of the latch permitting the spring to move the inner body (here rightwardly) to close the sound-emitter circuitry;

FIG. 8 shows the parts in the sounding condition, but with actuator member (here a golf tee) is about to silence the sound-emitting operativity and relatch the parts; and FIG. 9 shows the parts in the latched and non-sounding position of FIG. 6, by the actuator member shown in FIG. 8 now having silenced the sounding signal and re-latched (cocked) the device to again sound on a subsequent shot;

FIG. 10 is a side elevation view of the second embodiment of the overall sounder device, much in longitudinal cross-section;

FIG. 11 is a detailed view of the battery compartment region of the device, with the battery shown as about to be inserted into the compartment, the illustration being in a form similar to what is commonly called an exploded view; and parts are shown in longitudinal cross-section.

Figure 1:
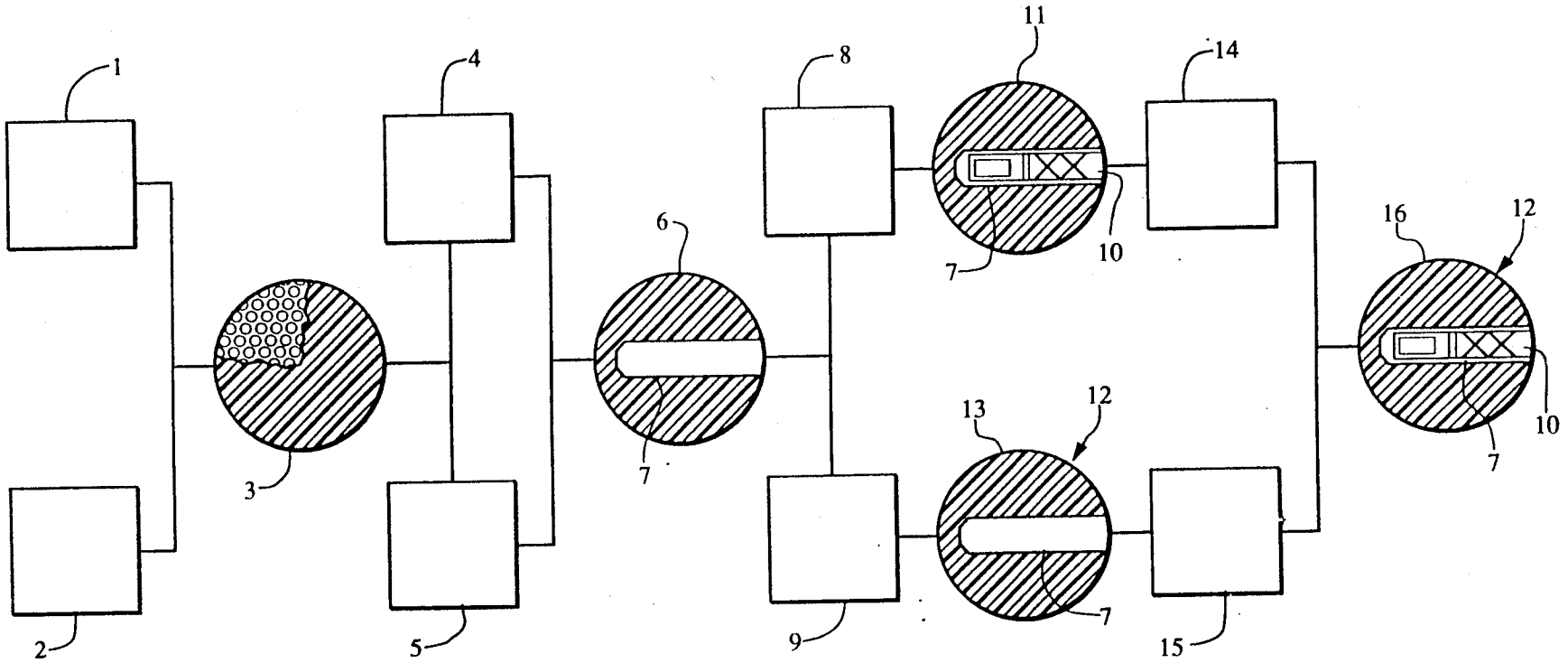
FIG. 1 is a schematic process chart, illustrating process steps and corresponding product natures at various stages of the overall process.

(To minimize any difficulty by what might be considered a crowding of the reference numerals to various components, particularly in FIGS. 6–9 and 10–11, the reference numerals are not duplicated on all views, where the illustrations make clear as to the correspondency between the various views.)

V. DETAILED DESCRIPTION OF ILLUSTRATIVE EMBODIMENTS OF THE INVENTION

V.(1). Concepts of the Novel Methods of Ball-Formation, for Utilizing the Sound-Emitter Devices As shown in the drawings, the concept of the advantageous sequence of manufacturing steps is illustrated in FIG. 1 as by sequential steps 1/2, 4/5, 8/9, and 14/15 in the manufacture of the different golf balls of FIGS. 3–5; and in the schematic showings of FIG. 1, each of the Step-pairs other than Steps 8 and 15 are shown merely as background for the Steps 8 or 15, either of which (Steps 8 or 15) illustrates the inventive concepts in a relationship to the other Steps.

(The slant lines of the text as in ½ are used to indicate alternativeness, as will be apparent below. The ball 3 as a product is shown in FIGS. 1–5 as in central cross-section, except the ball 3 in FIG. 1 is shown in only partial cross-section, about ¼ of the ball indicating a conventional dimpling of the ball's outer surface.)

Thus, as shown, a novel process of manufacture, the chart of FIG. 1 can be considered as an outline, but with a specific notice that the Steps and/or Substeps preliminary to Steps 8 or 15 may be varied, as may the Steps and/or Substeps subsequent to Steps 8 or 15, according to what is the choice of the manufacturer; for the Steps other than 8 and 15, respectively are merely associated with this invention in contrast to being an integral part of it, and are shown in the drawings only in that sense.

(Also, as to the process chart of FIG. 1, Steps are indicated by squares, and the ball as a product by circles: and numerals which relate to the Steps are used to identify the respective Step rather than indicate the number of the respective Step as being in the overall process; e.g., a Step numbered "5" is not indicated to be the 5th Step.)

Figure 2:
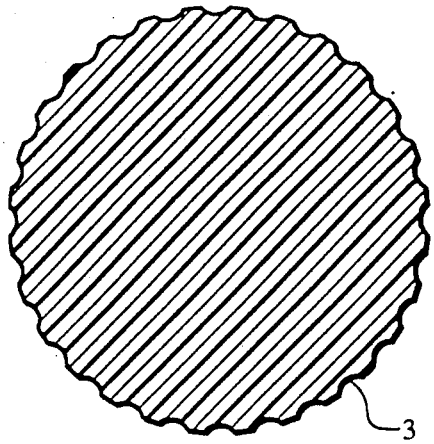
FIG. 2–5 are cross-sectional views through a golf ball for illustrating the inventive concepts, and more particularly.

In accordance with the inventive concepts as shown in FIG. 1, one or both of Steps 1 or 2 (FIG. 1) shapes the ball material into the spherical ball-shaped formation, as indicated by the ball symbol 3 (FIG. 1) and the solid-core ball illustration in FIG. 2; but neither of Steps 1 or 2 produces a cavity 7 for receiving a sound-emitting device 10; and as shown the sound-emitting device 10 being inserted after the spherical ball shape (ball symbol 3) is achieved, the device 10 escapes the vigorous procedures such as heat and crushing of the shape-forming Steps 1 and/or 2.

Instead, such internal cavity 7 is produced in one or both of Steps 4 or 5, both of which are subsequent to the stage at which the spherical ball shape formation has been attained by either or both of Steps 1 or 2.

The overall process schematically in FIG. 1 is shown there as follows, in summary form for emphasis to the concepts of the present invention in the content of the overall device:

Steps 1 and/or 2 may be whatever the manufacturer chooses to achieve the spherical ball-shape indicated by the product reference 3; and the chart (FIG. 1) shows that the spherical shape of ball 3 has been attained prior to any Step of cavity 7 formation or insertion of a sound-emitting device.

Steps 4 and 5 show optional cavity-forming Steps, e.g., drilling, boring, etc., which achieve in the ball 3 (now transformed into ball 6) a cavity 7 for receiving the sound-emitting device at a stage after the heating and other harsh-nature actions in Steps 1 and/or 2.

Next, as indicated, Steps 8 and 9 optionally refer to insertion of a sound-emitting device 10, prior a painting step, the sound producing device 10 now being in the cavity 7, and thus showing the ball now as 11. This assumes that Step 8 (rather than 9) has been selected for that Step; whereas, if Step 9 was selected, such as painting Step as indicated by the added reference detail 12, produces a ball now identified as 13, the cavity 7 still shown as unfilled.

Next of optional choice are Steps 14 and 15; and the choice of Steps 14 or 15 would depend on which of the Steps 8 or 9 had been chosen. Thus, Step 14 would be something like a painting Step or other external process, whereas Step 15, which had followed Step 9, now would include the insertion of the sound-emitter 10 in the cavity 7; and thus the results of either Steps 14 or 15 produces the completed ball assembly 16.

Figure 3:
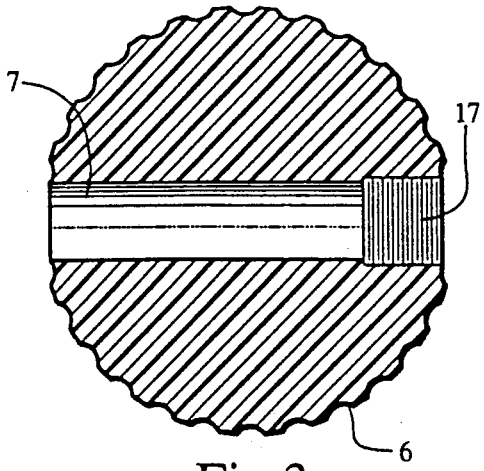

Fig. 3 illustrates a ball 6 (already in spherical) shape be Steps 1 or 2) which by a subsequent Step 4 or 5 has been provided with a recess or cavity 7 into which will be inserted a sound transmitter. The recess or cavity 7 is shown of cylindrical shape, diametrically extending fully through the ball 6; and the cavity 7 (as also the shorter cavities 7 in the embodiments of FIGS. 4 and 5) is threaded (here 17) to receive a sound-emitting device. (A cap (not shown) may be desirably provided to cover the outer end of the cavity in the embodiments of all of FIGS. 3–5.)

Figure 4:
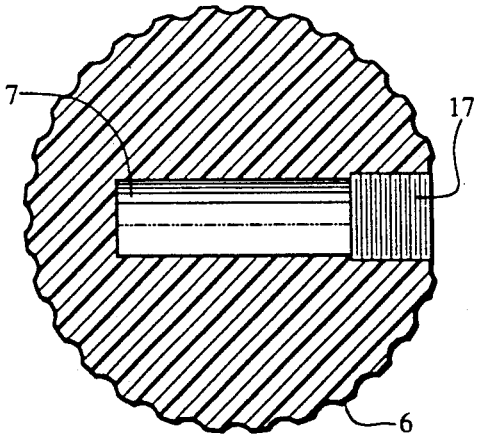

FIG. 4, similarly, ilustrates a ball 6 (already in spherical shape by Steps 1 or 2) which by a subsequent Step 4 or 5 has been provided with a recess or cavity 7 into which will be inserted a sound transmitter device. The recess or cavity 7 is shown of cylindrical shape, but as shown extends diametrically only a part of the way through the ball 6. The threaded inlet to the cavity 7 in the ball 6 is shown at 17.

Figure 5:
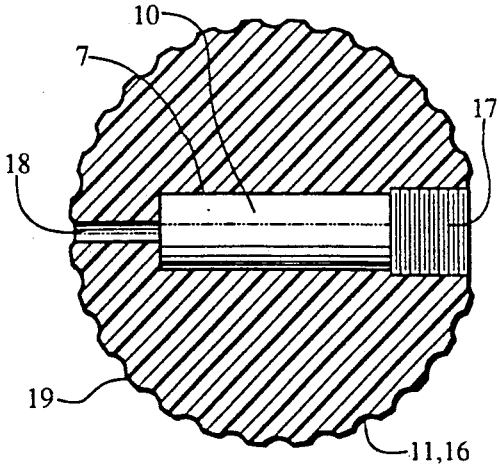

FIG. 5 likewise illustrates a ball 6 which is already in spherical shape by Steps 1 or 2 and which by a subsequent Step 4 or 5 has been provided with a recess or cavity 7 into which has been inserted a sound transmitter 10. The recess or cavity 7 is shown of cylindrical shape, diametrically extending only partway through the ball 6; and the showing of the embodiment of FIG. 5 differs from that of FIG. 4 by only FIG. 5 showing the sound-emission device 10 here shown as screwed into the cavity 7, and by the provision of a sound-exit hole 18 extending from the sound transmitter 10 to the outer surface 19 of the ball 6.

In all these embodiments of FIGS. 3–5, the procedural step of installing the sound-emission device is after the ball 3 has been formed into its spherical shape, thus avoiding the damage that the heat, ball-shaping, and other harsh factors of the ball-forming step of steps.

V.(2). Concepts of the Novel Sound-Emitter Device

Also shown in the drawings, FIGS. 6–9, sequentially as to operativity, the sound-emitting device 20 is shown in the form of a generally cylindrical shell 21; and, by the components described below, sound emission as shown schematically by the dash-line arcs 21*x* (FIGS. 7–8) is provided by providing the shell 21's rear or inner wall 22 (the wall at the left in the drawings) with an opening or openings 23.

(The sounder device 20 of the embodiment of FIGS. 6–9 is to be installed in a golf ball as illustrated above (FIG. 5) by sounder device 10 in a ball-cavity 7 in a ball 11, making an entire sounder ball 16; and thus terms such as "outer" and "inner" in describing the sounder device 20 are in reference to relative location as when the device 20 is installed in a ball.)

Figure 8:
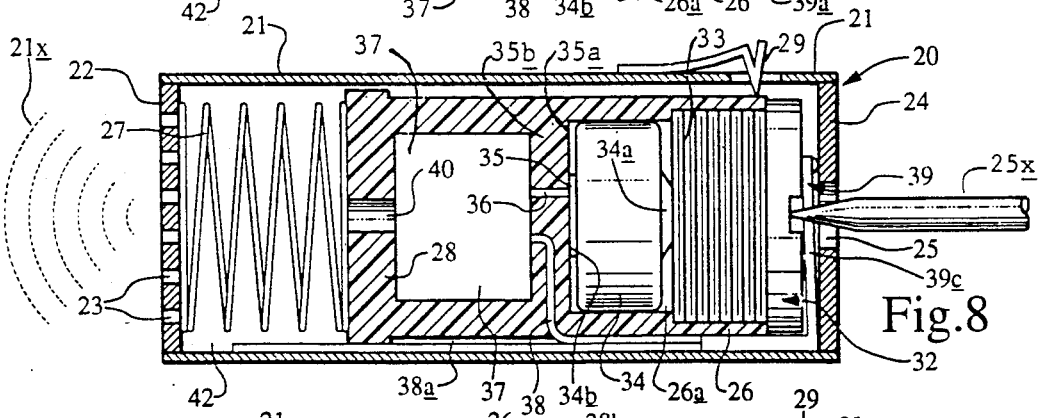
Figure 9:
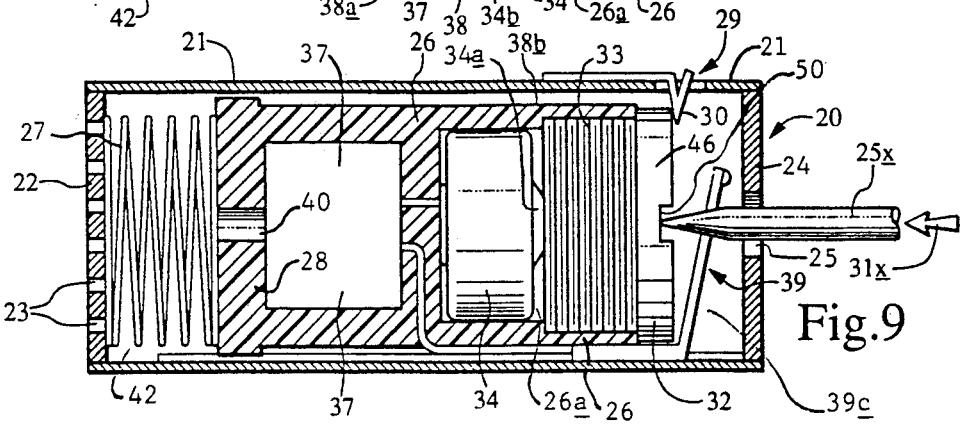

The opposite or front wall 24 (the wall at the right in the drawings) is a front or outer wall 24, and it is shown as formed from a piece which is non-integral and movable with respect to the shell 21, for providing access to the interior of the shell; and the outer front wall 24 is provided with a small opening 25 permitting the passing therethrough of some sort of conveniently available actuator (which would likely be the pointed shank of a golf tee), and indeed, a golf tee 25 is the actuator shown in FIGS. 8 and 9, for actuation described below.

Within the shell 21 is an inner shell 26. Preferably, it is molded of an epoxy, plastic, fiberglass or a carbon composition, encasing the electronic components, and having an outer (here rightward) compartment 26*a* and a rear (leftward here) compartment 26*b*.

Figure 6:
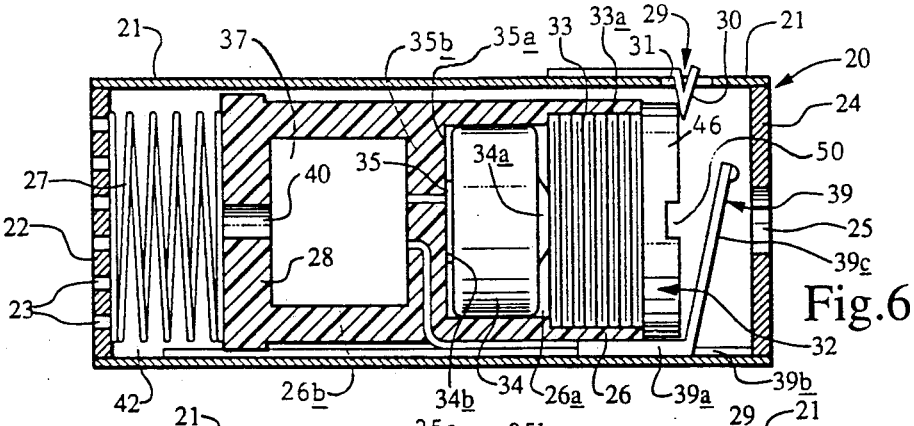
FIGS. 6–9 are axial cross-sections of a novel sound-emitter device of a first embodiment, and shown in different stages of use or operativity; and more particularly.
Figure 7:
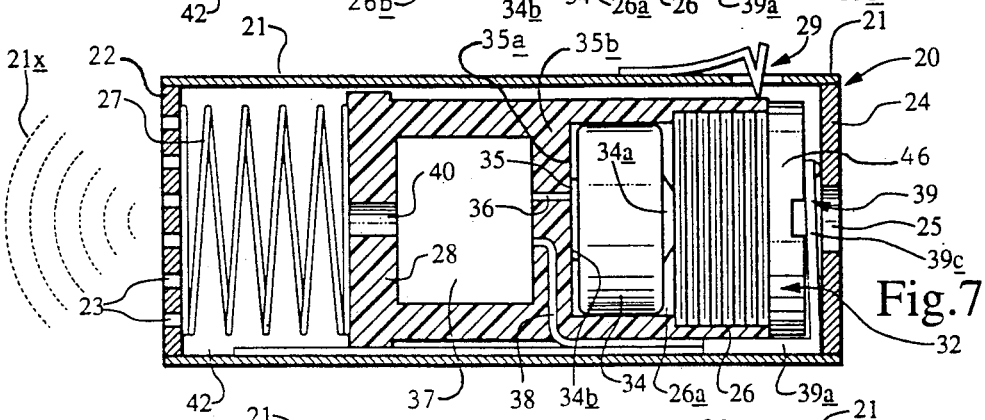

It is to be noted that as installed in a ball, the outer shell 21 is fixed (non-movable) with respect to the ball, but the inner shell 26 and its components are relatively movable with respect to the outer shell 21, providing actuation operativity described herein; and more particularly, as the ball is struck, the impact is directly imposed on the outer shell 21, achieving a relative movement of the two shells 21 and 26 (noticing the difference between FIGS. 6 and 7).

Those compartments 26*a* and 26*b*, as provided by the shell 26, are reciprocatingly movable with respect to the outer shell 21; and those components 26, 26*a*, and 26*b* are shown as biased in an outward direction by a compression spring 27 which bottoms against the rear wall 22 of the outer shell 21 and the rear (left) wall 28 of the inner shell 26.

Releasable holding means is provided for establishing and maintaining a cocked position of the inner shell 26 with respect to the outer shell 21, that releasable holding means being shown here as a latch 29, and illustrated in the drawings by observing that the inner shell 26 is being held in the cocked position in FIGS. 6 and 9 but in an uncocked position in FIGS. 7 and 8, the purpose being to establish the cocked position of the inner shell 26 which would be releasable to the sounding position (FIGS. 7 and 8) by the impact of a golf club striking the ball, to release inner shell 26 to its circuit-closing position in which the device begins to make its continuing sounding effect.

The latch 29 is shown, of flexible material, attached to the outer shell 21; and the latch 29 is shown with a U- or V-shaped nose 30, movable transversely of the shells 21 and 26, in a hole 31 in the outer shell 21; and the latch 29 retains the inner shell 26 from moving outwardly as urged by the spring 27, the device 20 being in a "cocked" condition (FIGS. 6 and 9) as caused by the actuator 25*x* pushing the inner cylinder 26 inwardly (leftwardly here) to be latched by the latch 29, this cocking being easy by the golfer using one hand to hold the ball (which thus holds the overall device 20), and his other hand to push (arrow 31*x*) the accessory 25*x*, and the latch 29 being one of a very small force, preferably not much more than is needed to maintain the latched condition of the inner shell 26 against the outward (here rightward) bias of the spring 27.

Correspondingly, the spring 27 itself is of a week nature, preferably just enough to force the inner shell 26 outwardly (rightwardly here) with a force which is strong enough to establish a good electrical contact of the sound-producing circuitry as set forth below, when the parts are in their non-latched condition.

A metal screw 32 has threads 33 which screw-threadedly engage threads 33*a* on the inside of the outer compartment 26*a*, the threaded operativity providing that the screw 32 may push (leftward here) against a terminal 34*a* of a cylindrical battery 34 and cause the other (inner side) terminal 34*b* of the battery 34 to electrically engage a contact plate 35 carried on the outwardly-facing side 35*a* of the intermediate wall 35*b* between compartments 26*a* and 26*b*.

(The circuitry as so far described comprises the metal screw 32, battery terminals 34*a* and 34*b* of battery 34, and the contact plate 35.)

The contact plate 35 has a wire 36 extending inwardly through the intermediate wall 35*b*, and the wire 36 is connected to the electronic device 37 which causes the sound-emission.

From the electronic device 37, a wire 38 leads transversely outwardly of the inner shell 26, then longitudinally outwardly along longitudinally-extending groove 38*a*, on the inner shell 26's outer face 38*b*, to a flexible contact clip 39 carried on that outer cylindrical wall 38*b* of inner shell 26.

The base portion 39*a* of the spring clip 39 is also carried along the outer wall 38*b* of the inner body 26, and the clip 39 is formed of metal, with a bend 39*b* such that the free arm 39*c* of the clip 39 is spaced (FIGS. 6 and 9) from the threaded body 32; but the clip arm 39*c* is resiliently bendable so as to make electric contact, when deformed as in FIGS. 7 and 8, with the body member 32 (also is made of metal), establishing or completing the electric circuit through the battery 34, the sounder device 37, wires 36 and 38, and the spring clip 39, by the shock-actuation of the ball being struck.

That striking, by the club-head against the outer wall 24, causes the unlatching of latch 29 as mentioned above, and is now seen to achieve the sound-emitting desired (FIG. 7), as the ball-hitting force causes the outer body 21's wall 24 to move (leftwardly here, and noticing the differences between FIGS. 6 and 7) relatively to the inner body 26 and its body member 32. In this relative movement, the wall 24 acts as an abutment mashing clip-arm 39*c* into electric contact with the body 32 as shown in FIG. 7.

This closed circuitry through both the battery 34 and sounder device 37 causes the desired signal, passing outwardly through a hole 40 in the inner shell 26's rear wall 28, through the chamber 42, and outwardly through the holes 23 in the outer shell 20's rear wall 22.

The sounding of the sounder device 37 will continue, after the shock-induced operativity-latched actuation of the circuitry through the sounder 37 as just shown, during the ball's flight time and bounce-along time of the shot, and after the ball finally comes to rest; but its intensity is not so much as to be distracting to anyone, even though continuing from the time of the striking impact throughout the time it takes for the golfer to walk or ride to the general area where he or she gets into the area where the ball is resting.

So, regardless of whether the golfer or the rules permit the golfer to pick up the dorment ball, the golfer will have been beckoned by the sound 21*x* to the area of the ball close enough for its visual sighting in most any kind of hidden or semi-hidden lie of the ball; and the ball is findable even if almost wholly hidden as by leaves or tall grass, etc.

(Suitable insulation of the electrical components is assumed, as to not interfere with the operativity as set forth.)

The sounder component 37 is herein indicated throughout merely quite schematically, for it is not a part of the present invention except to the extent and in the sense that it is an operatively-integral part of the overall combination; and in that sense may even be considered to be, or to be at, what might be termed as the heart of the overall invention, both as to operativity, and as to location in both the overall sounder device 20 and in the ball in whose interior the overall sounder device 20 is carried.

Silencing (as shown in FIG. 9 as just having been done) requires merely the minor task (FIG. 8) of pushing an available rod, golf tee shank 25*x*, etc., through the wall 24's hole 25, and interiorly of the device far enough that the outer body part (here shown as the head 46 of the screw body 32) of the inner shell body 26 slides (inwardly, here leftwardly) past the latch 29 (FIG. 9); and that latching opens (disengages) the contact of the clip arm 39*c* and the screwbody 32's outer head 46.

In the form shown, clip arm 39*c* (FIG. 9) is offset from the wall hole 25, accommodating passage of the rod or tee 25*x* in this easy manual effort, which as a single effort serves both to stop the sound but also cock the device for the next shot.

As another detail, the screwhead 46 is provided with a screwdriver slot 50 or similar detail, in registry with the location of the front wall 24's access hole 25, providing for the screw-thread (33/33*a*) axial (longitudinal) adjustability as desired, such as to vary the effect in length of the inner body 26, and providing, in cooperation with the removability of the outer wall 24, access to replace the battery 34.

Figure 11:
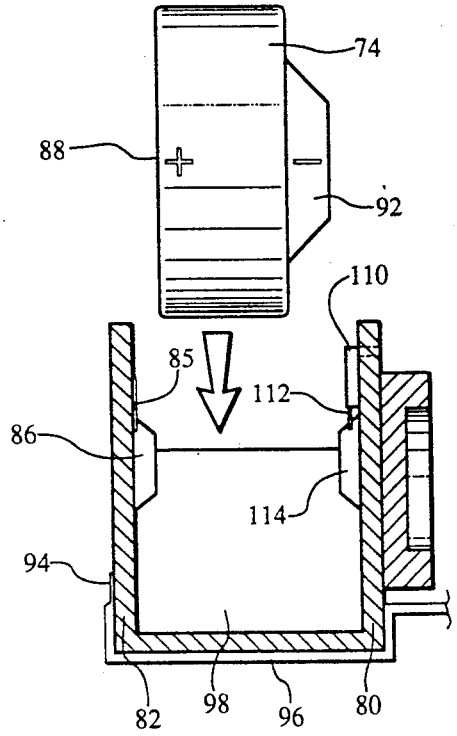
FIGS. 10 and 11 illustrate details of a second embodiment of the sounder device, and more particularly.
Figure 10:
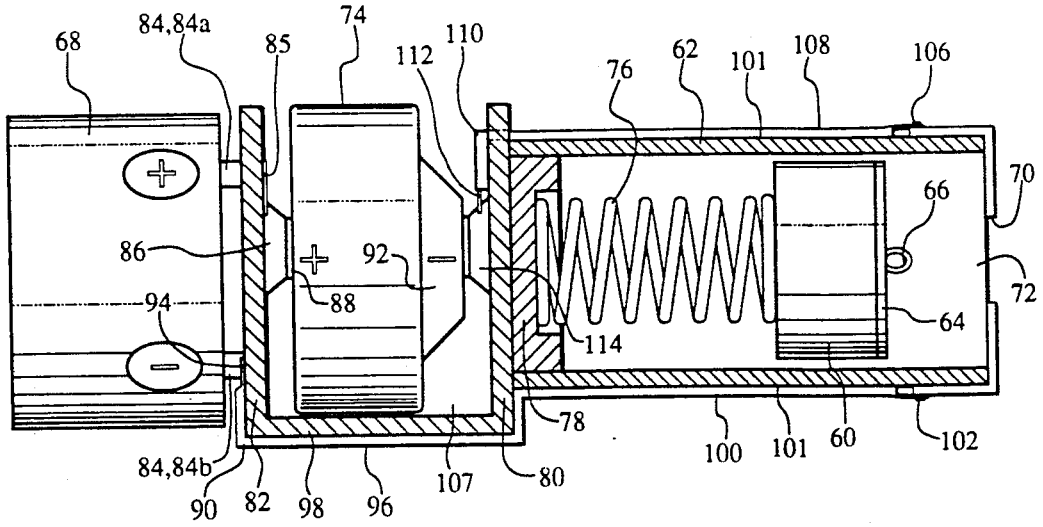

FIGS. 10–11 illustrate a second embodiment. Differing from that of FIGS. 6–9, this embodiment of FIGS. 10–11 shows an advantageous concept of minimizing movability.

More particularly, in FIG. 10 a piston 60 is slidably carried in a carrier tube 62, the piston 60 carrying on its outer end a contact plate 64, by which, upon an impact by a golf club operatively against the right end of the tube 62, effects an unlatching of the piston 60 from being held by a latch 66, all quite corresponding to the embodiment of FIGS. 6–9, the latch 66 providing resilient but relatively loose holding of the piston 60.

However, in FIGS. 10–11 only the piston 60 (and its contact plate 64) moves to achieve the two incidents of latch-operativity and sound-emission by electric switch control; although, like the earlier embodiment, the two goals, of silencing the sound-producer (here 68) and cocking the device for subsequent golf stroke, are provided to be achieved by the single manual force action of manually pushing a tee or other object through hole 70 in the transverse end wall 72 of the tube 62, and pushing on the piston 60's contact plate 64, inwardly (leftwardly here) far enough to latch the piston 60 inwardly of the latch 66, to the FIG. 10 position.

As shown in FIG. 10, this embodiment achieves some more construction simplicity in contrast to the first embodiment also by not requiring an inner shell as a carrier of an assembly of the battery and sound-producing or emitter device 68 of this embodiment.

Instead, in the FIG. 10 embodiment, the sound-emitter 68 and battery 74 are non-movably carried in the carrier tube 62; and only the piston 60 moves, it being urged in an outward (rightward here) direction by a spring 76.

Bottoming of the spring 76 for its force against piston 60 is a transverse wall 78 of the tube 62.

FIG. 10 also shows a pair of transverse walls, those being relatively outward (here rightward) wall 80 and an inner (here leftward) wall 82, which are spaced apart and receive between them the battery 74. The walls 80/82 are fixed with respect to the tube 62, and the walls 80/82 and the battery 74 are thus non-movable, except of course the battery 74 is removable for replacement.

Inwardly of the inner wall 82 the sound-producing device 68 is shown schematically, and with its prongs 84 extending through holes (not shown) in the inner transverse wall 82 which carries appropriate circuitry to provide the desired electric circuitry contact with the battery 74.

In the embodiment shown, the positive (here upper) prong 84*a* of the sound emitter 68 is in contact with a wire 85 which leads to a terminal 86 facing the battery 74, and particulary as shown to the battery's positive terminal 88; and an outer wire 90 leads to circuitry providing the switching operativity desired, and leading back to the other (here nagative) terminal 92 of the battery.

That circuitry as shown is as follows: The prong 84 (84*b*) of the negative side of the sounding device 68 contacts a terminal 94 on the inner (left) side of the inner transverse wall 82; and from that terminal 94 wiring 96 is carried along the outer surface of the battery-walls spacer wall 98, and a wire-portion 100 along the outer surface 101 of the tube 62. The wire-portion 100 is connected to a terminal 102 which is electrically connected to the outer (rightwardly here) transverse wall 72; and, when the piston 60's contact plate 64 moves outwardly (by the force of the golf club striking the metallic outer wall 72 to achieve the unlatching of the latch 66), the piston's contact plate 64 comes into electric engagement with the outer wall 72. The outer wall 72 has a terminal 106 to which is connected a wire 108 which leads along the outer side 101 of tube 62 to a terminal 110 on the outward transverse wall 80 of the battery compartment (107) between the wall 80 and 82.

This terminal 110 is connected to a wire 112, which is connected to the terminal 114 also on wall 80, the terminal 114 being the one which is engaged by a corresponding terminal 92 of the battery 74, thus completing the circuity through the battery 74 and the sound-emitting device 68 when the piston 60 is unlatched from its latched position shown in FIG. 10.

The embodiment of FIGS. 10 and 11 also advantageously achieves economy in that its switchability from sounding condition to sound-silent condition does not depend on relative movement of two rather major components (i.e., as was the case with the carrier members 21 and 26 of FIGS. 6–9) but, instead, achieves switching to the sounding mode merely by the jostling effect inherent in the energy of a golf club having been swung into the hitting zone at impact with the ball.

VI. CONCLUSION

It is thus seen that these "golf ball finder" manufacturing concepts, as to both a process of manufacturing and as to a golf ball as a device, and shock actuated sound-emitter device concepts especially for golf balls, the devices being constructed according to these various inventive concepts, provide desirable and advantageous process and device particulars, yielding special and particular advantages as to golf balls.

In summary as to the nature of the overall and advantageous concepts, their inventiveness is shown by novel features of concept of process and construction shown here in advantageous combination, and by the novel concepts hereof not only being different from all the prior art known, but because the achievement is not what is or has been suggested by or to those of ordinary skill in the art, especially realistically considering these concepts as combinations comprising steps and components which individually are similar in nature to what is well known to many persons, surely including most of the many and very competitive makers of golf balls for many years; and no prior art has suggested the modifications of any other prior art to achieve the particulars of the novel concepts here achieved, with the special advantages which the overall process and device provide.

The novelty both of concept and construction is specified herein, yielding advantages especially as mentioned herein, even though the prior art shows different type of manufacturing steps for golf balls and sound-emitting golf balls of various natures for years; and quite certainly no particular combination of prior art details as here presented in these overall combinations has been suggested by the prior art, this achievement in its particular details being a substantial and advantageous departure from prior art. And particularly is the overall difference from the prior art significant when the non-obviousness is viewed by a consideration of the subject matter of the overall processes and devices as a whole, as combinations integrally incorporating features different from the prior art, in contrast to merely separate details of novelty themselves, and further in view of the prior art devices not achieving particular advantages here achieved by this combination of process and devices.

Accordingly, it will thus be seen from the foregoing description of the invention according to these illustrative embodiments, considered with the accompanying drawings, that the present invention provides new and useful concepts of a novel and advantageous process and devices, having and yielding desired advantages and characteristics in formation and use, and accomplishing the intended objects, including those hereinbefore pointed out and others which are inherent in the invention.

Modifications and variations may be effected without departing from the scope of the novel concepts of the invention; accordingly, the invention is not limited to the specific embodiments, or form or arrangement of parts herein described or shown.

I claim:

1. A golf ball including a sound-emitting device, comprising, in combination:

an outer carrier member carried by the golf ball interiorly thereof;

an inner carrier member;

a battery;

an impact-receiving member carried by the outer carrier member;

a sound-emitting means, electrically energizable;

electric circuitry operatively connecting the sound-emitting means and the battery; switch means in said circuitry in operative series with the battery and the sound-emitting means;

the switch means and the impact-receiving means being carried respectively by the inner carrier member and the outer carrier member;

the inner carrier member and the outer carrier member being relatively movable into and between a sound-silent condition in which the switch means is in an open-circuit condition, and a sound-emitting condition in which the switch means is in a closed-circuit condition;

a spring operatively interconnecting the outer carrier member and the inner carrier member, and biasing the inner carrier member and the outer carrier member toward a relative position having sound-emitting condition of the switch means, and maintaining that sound-emitting condition until opposing force is exerted as specified below;

releasable holding means operative to maintain the outer carrier member and the inner carrier member in a relative position which maintains sound-silent condition of the switch means;

the releasable holding means, by impact of a golf club upon the impact-receiving member, permitting the spring to cause the inner carrier member and the outer carrier member to move relatively to one another to achieve sound-emitting condition of the switch means;

and there is provided operative access to the inner carrier member for manual force to be operatively applied to the inner carrier member to achieve silencing of the sound-emitting means; and also to establish said releasably-held condition of the releasable holding means to maintain the silence of the sound emitting means, and to cook the device for the subsequent impacting of the ball by a golf club to re-start the sound-emitting operativity of the sound-emitting means, by a single manual force action of the user.

2. The invention as set forth in claim 1, in a combination in which the outer carrier is a tubular member which provides a shell within which the inner carrier member is slidably carried.

3. The invention as set forth in claim 1, in a combination in which the inner carrier member is a body member having a pair of chambers respectively carrying the battery and the sound-emitting means.

4. The invention as set forth in claim 1, in a combination in which the inner carrier member includes and end having a cylindrical recess having female threads, and there is also provided a male-threaded body member screw-threadedly connected to the inner carrier member and providing one part of the releasable holding means, the other part of the releasable holding means being carried by the outer carrier member.

5. The invention as set forth in claim 1, in a combination in which the said male threaded body member provides a part of the circuitry.

6. The invention as set forth in claim 1, in a combination in which the inner carrier member carries an arm member which is operatively in the said circuitry and is adjacent the impact-receiving means of the outer carrier member and the adjacent end of the inner carrier member and the arm member is movable to provide that the circuitry is closed upon receiving an impact against the impact-receiving member, and the circuitry is open when the inner carrier member and the outer carrier member are in their condition of being releasably held in their cocked position.

7. The invention as set forth in claim 1, in which the outer carrier member has a transverse wall at its inner end, and the inner carrier member has a transverse wall at its inner end, and the spring is operatively bottomed against said walls.

8. The invention as set forth in claim 1, in a combination in which the releasable holding means is a latch means.

9. The invention as set forth in claim 8, in a combination in which the latch means comprises a resilient member attached to the outer carrier member, and provides a holding of them in sound-silent condition by the resilient member's releasable engagement of the inner carrier member unless some external force causes a release of latch means by the inner carrier member forcing the resilient member to move from that latching engagement with the inner carrier member.

10. A goft ball including a sound-emitting device, comprising, in combination:

a carrier member carried by the golf ball interiorly thereof;

a battery;

a sound-emitting means, electrically energizable;

electric circuitry operatively connecting the sound-emitting means and the battery;

switch means in said circuitry in operative series with the battery and the sound-emitting means;

a movable actuator member movably carried by the carrier member;

the movable actuator member and the carrier member being relatively movable into and between a sound-silent condition in which the switch means in an open-circuit condition, and a sound-emitting condition in which the switch means is a closed-circuit condition;

a spring operatively interconnecting the carrier member and the movable actuator member, and biasing the movable actuator member toward a relative position having sound-emitting condition of the switch means, and maintaining that sound-emitting condition until opposing force is exerted as specified below;

releasable holding means operative to maintain the carrier member and the movable actuator member in a relative position which maintains sound-silent condition of the switch means;

the releasable holding means, by impact of a goft club upon the ball, permitting the spring to cause the movable actuator member the carrier member to move relatively to one another to achieve sound-emitting condition of the switch means;

and there is provided operative access to the movable actuator member for manual force to be operatively applied to the movable actuator member to achieve silencing of the sound-emitting means, and also to establish said releasably-held condition of the releasable holding means to maintain the silence of the sound-emitting means, and to cock the device for the subsequent impacting of the ball by a goft club to re-start the sound-emitting operativity of the sound-emitting means, by a single manual force action of the user.

11. The invention as set forth in claim 10, in a combination in which the carrier member is a tubular member which provides a shell within which the movable actuator member is sliadably carried.

12. The invention as set forth in claim 10, in a combination in which the movable actuator member is a body member removed from the battery and the sound-emitting means, providing that neither of those two components move with the movable actuator member.

13. The invention as set forth in claim 10, in which the carrier member has a transverse wall at its inner end, and the innner carrier member has a transverse face at its inner end, and the spring is operatively bottomed against said wall and face.

14. The invention as set forth in claim 10, in a combination in which the releasable holding means is a latch means.

15. The invention as set forth in claim 14, in a combination in which the latch means comprises a resilient member attached to the outer carrier member, and provides a holding of them in sound-silent condition by the resilient member's releasable engagement of the inner carrier member unless some external force causes a release of latch means by the inner carrier member forcing the resilient member to move from that latching engagement with the inner carrier member.

* * * * *